United States Patent [19]

Huff et al.

[11] 4,079,998

[45] Mar. 21, 1978

[54] LIXIVIANT RECIRCULATOR FOR IN SITU MINING

[75] Inventors: Ray Vincent Huff, Thatcher, Ariz.; Daniel J. Moynihan, Chelmsford, Mass.

[73] Assignee: Kennecott Copper Corporation, New York, N.Y.

[21] Appl. No.: 736,302

[22] Filed: Oct. 28, 1976

[51] Int. Cl.[2] ..... E21B 43/28

[52] U.S. Cl. ..... 299/4; 166/115; 166/222; 166/106

[58] Field of Search ..... 299/5, 17, 4; 166/179, 166/309, 115, 114, 99, 105.1, 106, 222, 223, 167, 169; 175/100

[56] References Cited

U.S. PATENT DOCUMENTS

| | | | |
|---|---|---|---|
| 1,448,818 | 3/1973 | Stokes | 166/222 X |
| 2,703,145 | 3/1955 | Hildebrandt | 166/222 |
| 2,946,565 | 7/1960 | Williams | 166/106 X |
| 3,958,641 | 5/1976 | Dill et al. | 299/17 |

*Primary Examiner*—Ernest R. Purser
*Assistant Examiner*—William F. Pate, III
*Attorney, Agent, or Firm*—John L. Sniado; Anthony M. Lorusso

[57] ABSTRACT

A downhole recirculator for injecting two-phase lixiviant from a tubing string into a leaching interval of an in situ mine field injection hole, and for circulating the injected lixiviant within the leaching interval. The recirculator includes a core device which is adapted to be readily inserted or removed from its operating position in a fixture defining the upper limit of the leaching interval. The core device includes an induction valve arrangement whereby a primary flow of two-phase lixiviant supplied from the minefield surface by way of the tubing string induces a secondary flow of lixiviant from regions of the injection hole near the top of the leaching interval. The primary flow two-phase lixiviant is combined with the secondary flow lixiviant and injected to a region near the bottom of the leaching interval to establish a circulatory motion of lixiviant within the leaching interval.

3 Claims, 5 Drawing Figures

FIG. 1.
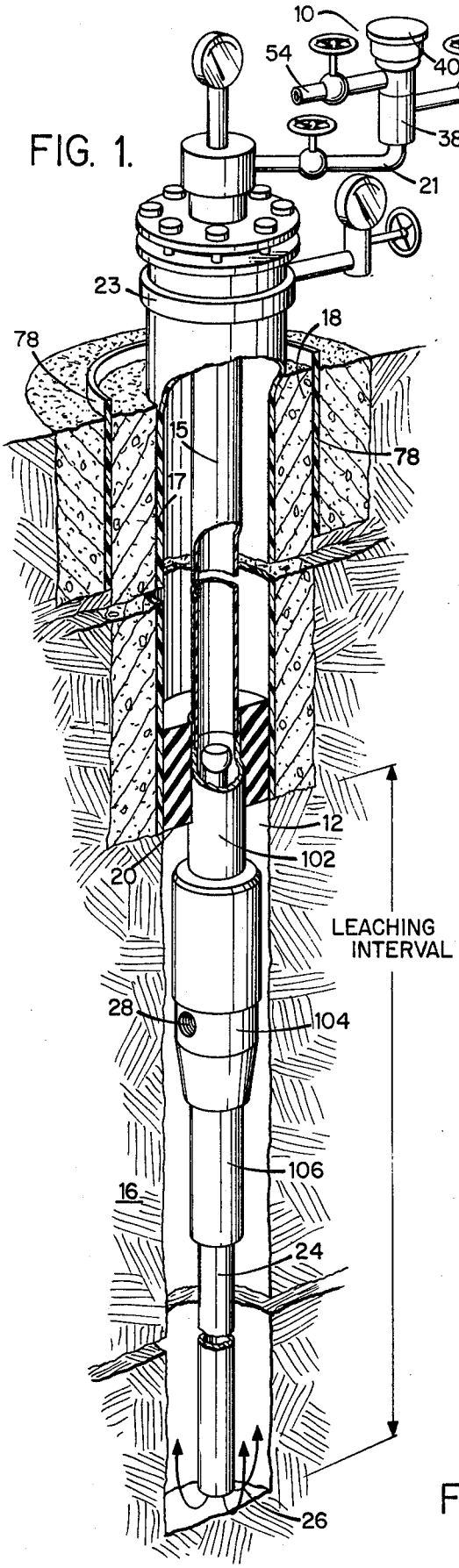
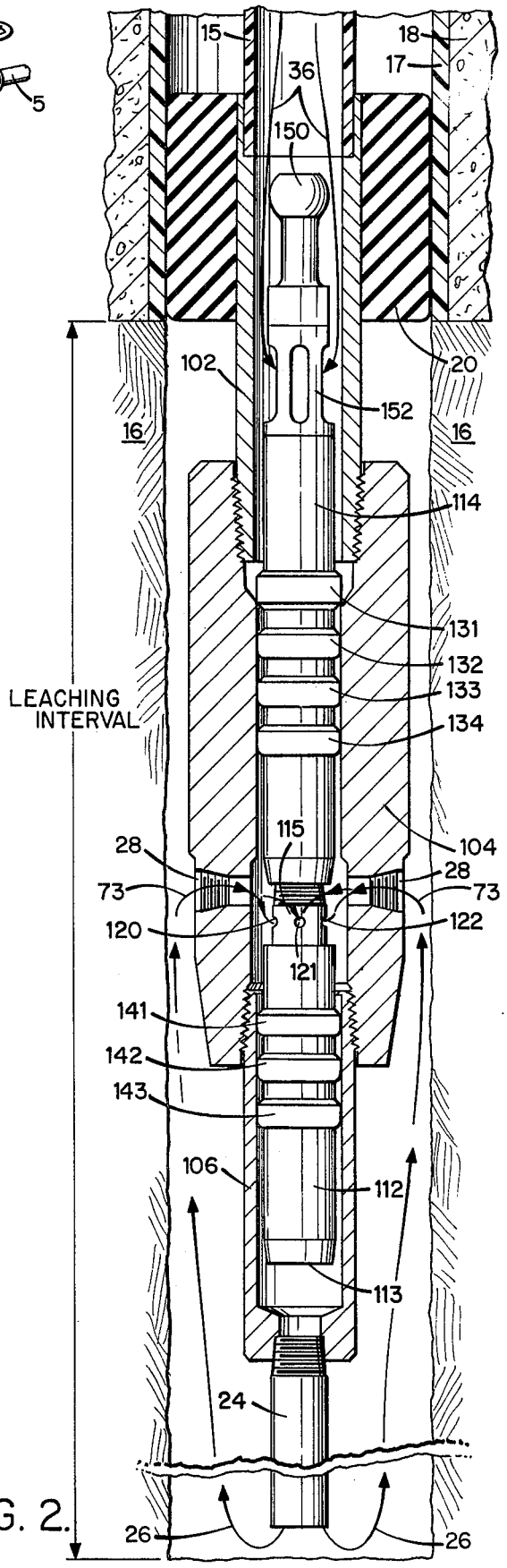
FIG. 2.

LIXIVIANT RECIRCULATOR FOR IN SITU MINING

BACKGROUND OF THE INVENTION

The present invention relates to in situ mining of metal values; and, more particularly, to a downhole device for recirculating lixiviant in a leaching interval.

The subject matter of the present application is related to the subject matter of patent application Ser. No. 724,548, filed Sept. 20, 1976, entitled "In-Situ Method and Apparatus," and that application is incorporated by reference in the present application.

As noted in the incorporated reference, much contemporary effort is directed to the development of processes and hardware permitting the efficient and economic extraction of metal values from low grade porphyry ores residing in relatively large deep-lying deposits, whereby the metal value extraction may be accomplished with minimal environmental impact.

Although in situ mining can be with a single hole generally, for economic consideration, in situ mining processes require at least two bore holes drilled to the lowermost level of the desired leaching interval in the ore deposit. A packer and lixiviant injector is then affixed to the interior of a first, or injection, hole at the top of the desired leaching interval. Leach liquor is pumped down the injection hole and into the leaching interval to establish a relatively high pressure reservoir of leach liquor in the portion of the injection hole selected as the leaching interval. A relatively low pressure is established in one or more nearby production holes at portions of those holes lying within the leaching interval. Lixiviant from the injection hole reservoir passes through fissures in the ore along a pressure gradient between the injection hole and the production holes. As the lixiviant passes through the ore, metal values are leached. The pregnant leach liquor is pumped to the surface by way of the production holes and processed to recover the metal values.

The broad concept of leaching metal values from ore formations in situ is known in the art. However, the known techniques have proven to be effective only for shallow ore deposits where fractures are relatively large, or for deep deposits where the ore has first been rubblized to establish relatively large passages for the lixiviant.

The incorporated reference discloses an in situ deep mining technique whereby the metal values such as nickel and copper, may be recovered from deep, hard rock formations characterized by low porosity. For example, using the latter technique, copper can be recovered from ore deposits having fractures on the order of 30–300 microns in width utilizing a lixiviant which contains very small oxygen bubbles admixed with a leach liquor, wherein the oxygen bubbles are smaller than fractures residing in the ore. As a result, there is no requirement for rubblizing the ore prior to leaching.

However, as disclosed in the incorporated reference, in order to maintain a two phase lixiviant solution with sufficiently small oxygen bubbles, the lixiviant must move continuously at a velocity above a predetermined value within the injection hole. Accordingly, the referenced disclosure teaches the use of a device for recirculating the injection hole lixiviant within a leaching interval wherein the injection hole lixiviant is injected into the leaching interval through a venturi-type exhauster having an extended injection nozzle (also called stinger or tail pipe) which is downwardly directed and terminated within the leaching interval. The two phase solution of lixiviant and oxygen bubbles is maintained by establishing a continuous vertical circulation of lixiviant between the outlet of the injection nozzle (located in the lower portion of the leaching interval) and the recirculating device which provides at least one aspirator passage (located in the upper portion of the leaching interval). With this configuration, a primary flow of lixiviant passes from the surface through the injection nozzle. The primary flow induces a relatively low pressure near the aspirator passage. Consequently, the lixiviant ejected at the nozzle tends to flow from that region at the bottom of the leaching interval toward the top of the leaching interval and through the aspirator passage to form a secondary flow into the injection nozzle, thereby achieving a continuous vertical circulation. In addition, oxygen which has come out from the solution and started to accumulate near the top of the leaching interval is also drawn into the aspirator passage and re-introduced to the primary fluid stream.

In the incorporated reference, the exhauster is permanently affixed to the injection hole lixiviant supply tubing string and a sealing packer assembly which defines the upper limit to the leaching interval. While this configuration does generally provide continuous circulation of the injection hole lixiviant sufficient to maintain a two-phase leaching solution, the recirculation device described in that reference does place substantial limits on the long term yields and efficiencies of the in situ mine for a number of reasons. One such reason is that the effectiveness of the recirculation device falls off with time due to the accumulation of debris and mineral deposits within the device. As a result, the lixiviant circulation, while initially satisfactory, degrades over time to a point where the two phase solution may no longer be adequately maintained.

A further limitation of the reference system relates to the flow rate of lixiviant into the injection hole. Since it is known that the two phase solution may only be maintained at velocities above a predetermined value, circumstances which require a lowering of the injection hole velocity into an injection hole may result in lixiviant velocity below the required minimum.

In order to overcome the first of these limitations, a clogged recirculation device may be replaced with another recirculation device which is deposit free. Regarding the latter limitation, a relatively low lixiviant flow rate may still provide satisfactory lixiviant velocity by providing a relatively small diameter injection tube which is coupled to the recirculation device in the injection hole. However, in the configuration disclosed in the incorporated reference, replacement of either the recirculation device or injection tubing string, or both requires removal of the entire injection tubing string and packer assembly, including the recirculation device, with a consequent relatively large expense.

Accordingly, it is an object of the present invention to provide a recirculation device which is readily installed and retrieved from the operating position in a packer assembly of an injection hole of an in situ mining configuration.

A further object is to provide a recirculation device which may accommodate interchanging of the injection tubing string while in its operating position in an injection hole of and in situ mining configuration.

SUMMARY OF THE INVENTION

The present invention provides a downhole recirculator or exhauster for injecting and circulating two-phase lixiviant in the leaching interval of an in situ minefield injection hole. The recirculator includes a core device adapted to be readily inserted into or removed from an associated seating means in a downhole packer assembly defining the top of the leaching interval. With the core device in its operating position in the seating means, a primary flow of two-phase lixiviant is pumped down by way of the tubing string and through the core device to an exit port for injection into the injection hole near the bottom of the leaching interval. The primary flow induces a secondary flow into the core device from the uppermost regions of leaching interval. The secondary flow includes lixiviant injected near the bottom of the leaching interval which has not flowed into the ore body, and in addition, gaseous oxygen which has separated from the two phase lixiviant and accumulated near the top of the injection interval. As a result, the secondary flow is rejoined with the primary flow.

The core device also includes a retrieval means attached to its upper portion so that a wire-line fishing tool passed down through the lixiviant tubing string may be utilized to withdraw the core device without removing either the lixiviant tubing string or packer assembly.

Furthermore, the core device may also include a means for coupling to a relatively small diameter inner tubing string which may be inserted within the lixiviant tubing string. When the flow rate of lixiviant into the injection hole is relatively low, a relatively small diameter tubing string may readily be inserted through the lixiviant tubing string and coupled to the recirculator in place within the injection interval. With this configuration, the resultant lixiviant velocity is sufficient to maintain a two-phase solution.

BRIEF DESCRIPTION OF THE DRAWINGS

The foregoing and other objects of this invention, the various features thereof, as well as the invention itself, may be more fully understood from the following description, when read together with the accompanying drawings in which:

FIG. 1 is an exemplary injection hole configuration for in situ minefield in accordance with the present invention, FIG. 2 shows a cutaway view of the core device and associated seating assembly for the configuration of FIG. 1;

DESCRIPTION OF THE PREFERRED EMBODIMENT

Figure 3:
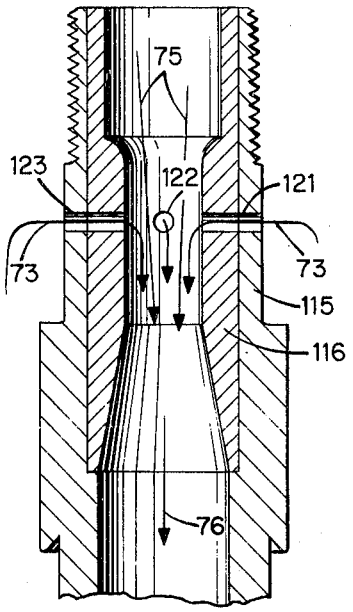
FIGS. 3 and 4 show a cutaway view of exemplary venturi chamber sections suitable for use in the core device of FIGS. 1 and 2.

FIGS. 1–3 illustrate an injection hole configuration for in situ minefield in a manner similar to that illustrated in FIGS. 2 and 3 of the incorporated reference. In FIGS. 1–3 of this disclosure, elements having counterparts in FIG. 2 of the incorporated reference are identified by identical reference numerals.

In FIGS. 1 and 2, the injection hole 12 extends into ore deposit 16. A casing 17, encased in cement 18, extends about injection hole 12 to the upper extremity of the leaching interval. The upper extremity of the leaching interval is defined by the packer which comprises an expandable rubber element 20 disposed about a central mandrel 102. A lixiviant tubing string 15 is coupled to the mandrel 102. As shown, the packer 20 is set within the casing 17 in a manner isolating the leaching interval of the injection hole from the regions exterior to the tubing string 15 in the remainder of the injection hole.

As illustrated the leaching interval is defined by the packer 20 at its upper extremity and by the termination of the hole 12 at its lower extremity. In other embodiments, for example, the leaching interval may be defined at its lower limit by a packer assembly which plugs an injection hole which continues into the ore deposit 16.

Within the leaching interval, and connected serially from the mandrel 102, is a tubular crossover seal nipple 104 (with aspirator 28), seating nipple 106 and tailpipe 24, with the latter extending to a point near the bottom of the leaching interval.

An elongated core device is disposed within the assemblies 102, 104 and 106. The core device comprises an injection nozzle portion 12 at its lowermost end and terminating in exit port 113, a lixiviant input section 114 at its other end, a venturi chamber section 115 intermediately disposed, and secondary fluid input ports 120–122, and 123 (not shown).

The inner diameter of mandrel 102, tubing string 15, cross-over seal nipple 104, and seating nipple 106 are all greater than the outer diameter of any portion of the core device thus far described.

The core device further includes a seating member 131 and three sealing bushings 132–134 arranged on the outside of the input section 114. The seating member and the bushings are arranged so that when the core device is fully inserted in the assembly formed by members 102, 104 and 106 (as shown in FIG. 2), the interior of the venturi section 115 is coupled by way of the secondary fluid input ports 120-123 to the upper portion of the leaching interval, while isolating leaching interval exterior to the core device from the region interior to the tubing string 15. In addition, with the core device fully seated, the interior of tubing string 15 is coupled by way of input section 114, venturi section 115 and the nozzle section 112 (and exit port 113) to a point near the bottom of the leaching interval.

Figure 4:
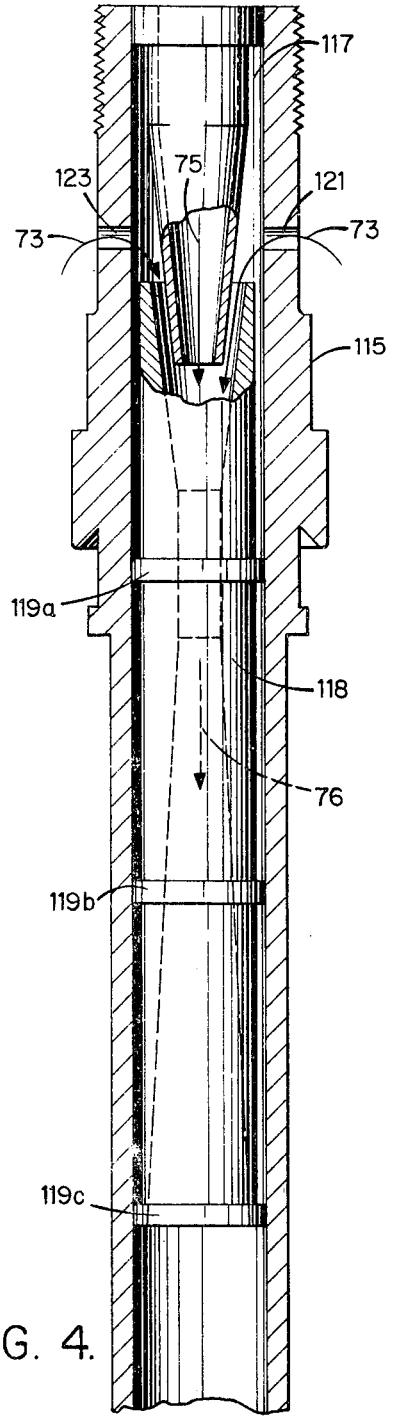

FIGS. 3 and 4 show cutaway views of the venturi chamber section 115 for two preferred embodiments. In the FIG. 3 embodiment, insert 116 is press fitted within section 115 to establish the required induction valve configuration. In the FIG. 4 embodiment, a nozzle 117 is press fitted within section 115 together with delivery jet 118 which is positioned by seals 119a-c. Of course, alternative induction valve configurations may readily be used in other embodiments.

In the present invention, a second set of sealing bushings 141-143 are arranged on the outer portion of the injection nozzle section 112 in a manner establishing a flow path from the exit port 113 of nozzle 112 only to the lower portion of the leaching interval by way of the tailpipe 24. In other embodiments, the elongated nozzle section 112 of the core device may be sufficiently long to extend to a point near the bottom of the leaching interval. In such embodiments, the seating nipple 106 and tailpipe 24 are not required in accordance with the present invention.

As indicated in FIGS. 2–4, in the present configurations, lixiviant injected by way of tubing string 15 (indicated by arrows 36) passes into the input port section 114 of the core device and through the venturi chamber (indicated by arrows 75) in FIGS. 3 and 4, through that chamber and into the leaching interval by way of the exit port 113 and tailpipe 24 (indicated by arrows 26). The relatively rapid flow of the lixiviant through the venturi chamber section 115 causes a relatively low pressure to exist within the secondary fluid ports 120–123. As a result, there is a general upward flow of lixiviant from the exit portion of the tailpipe 24. This upward flow produces a secondary flow (indicated by arrows 73) from the upper regions of the leaching interval through the port 28 and secondary ports 120–123, where that secondary flow rejoins the main stream of lixiviant (indicated by arrow 75) to form the composite stream (indicated by arrow 76). Accordingly, the core device illustrated in FIGS. 2 and 3 performs a substantially similar function to the exhauster described in the incorporated reference. However, because of the particular configuration of the present invention, the core device in FIGS. 2–4 is readily removable from the fixed assembly formed by members 102, 104 and 106. This is in direct contrast with the assembly described in the incorporated reference where, in order to remove an inoperative exhaustor, the entire packer assembly and tubing string must be withdrawn from the injection hole.

In the present embodiment, the core device further includes a fishing neck 150 arranged with a ported cage assembly 152. These elements are configured so that a conventional wireline fishing tool may readily be dropped down the tubing string 15 to engage the fishing neck 150. When engaged, the wire-line may be utilized to pull the core device from its operating position. Of course, a similar core device may readily be re-inserted to the operating position merely by pressing the device into the operating position with a suitable tool. Alternatively, the core device may be dropped or pumped down the injection tubing string. The cage assembly 152 permits relatively good fluidic coupling between the input section 114 and the interior of tubing string 15, while also providing sufficient structural rigidity to accommodate wire-line retrieval of the core device.

Figure 5:
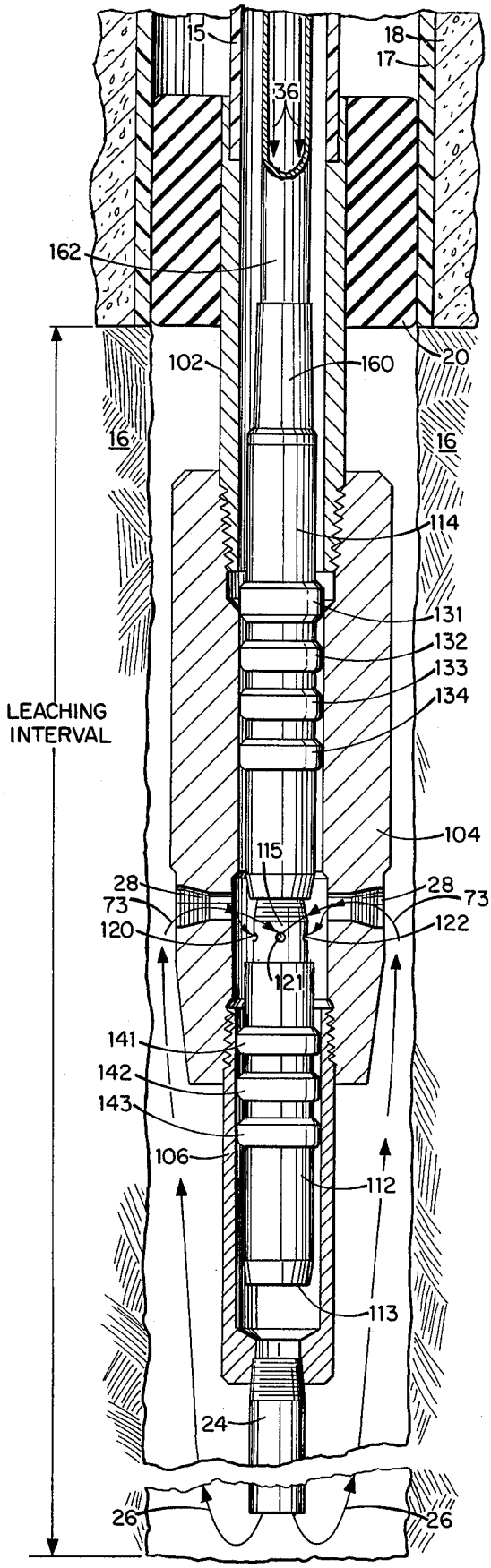
FIG. 5 shows a core device with a flow rate adaptor suitable for use in the configuration of FIG. 1.

In accordance with the present invention, the core device may also accommodate a relatively low flow rate of lixiviant while still maintaining a sufficiently high lixiviant velocity to support a two-phase lixiviant. FIG. 5 illustrates a core device generally similar to that of FIG. 2 but wherein the ported cage assembly 152 and fishing neck 150 have been replaced with a flow rate adaptor 160 attached to input section 114. An inner tubing string 162 carrying the lixiviant flow 36 is attached to the upper end of adaptor 160. In operation, the inner tubing string 162 may be inserted within the tubing string 15 with the flow rate adaptor 160 attached to the lowermost end. The inner tubing string has a sufficiently small diameter so as to establish a relatively high velocity for the fluid passing therethrough for the given flow rate. The small diameter inner tubing string 162 and flow rate adaptor 160 may be readily coupled to the input section 114 of the core device from the minefield surface a conventional manner, for example by a threaded connection. Alternatively, the flow rate adaptor may be connected to the input section 114 of the core device prior to insertion of the inner tubing using conventional downhold assembly techniques. In any of these embodiments, the two-phase solution required for effective in situ mining may readily be attained without requiring disassembly or removal of the packer assembly or tubing string.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. In an in situ minefield injection hole which includes a leaching interval adjacent the bottom thereof and isolated from the remainder of said injection hole by a packer, said packer having a central opening formed therein and extending to a casing in said injection hole, a primary fluid tubing string and a hollow mandrel being engaged in communicating relationship in said central opening, and a hollow cylindrical sealing nipple assembly depending from and in communication with said mandrel, said nipple assembly having at least an aspirator formed in a wall thereof at a point in said leaching interval remote from said bottom, a downhold recirculator for two-phase lixiviant injected through said primary fluid tubing string into said leaching interval comprising:

A. a retrievable core device for insertion through said primary fluid tubing string to a seated position within said mandrel and said nipple assembly, said hollow core device including:
   i. a primary fluid input port for the entry thereto of two-phase lixiviant from said primary fluid tubing string;
   ii. at least a secondary fluid input port formed through the wall of said core device and communicating with a venturi chamber formed in said core device, said secondary fluid input port being in fluid communication with said aspirator when said core device is in said seated position.
   iii. at least an exit port for the passage of said two-phase lixiviant from said core device to said leaching interval adjacent said bottom; and
   iv. an upper neck portion engageable to remove said core device through said primary fluid tubing string; and B. sealing members disposed between and joining the outer walls of said core device to the inner walls of said sealing nipple assembly at points above and below said aspirator when said core device is in said seated position, whereby the primary flow of said two-phase lixiviant through said venturi chamber induces a secondary flow of said lixiviant from said leaching interval through said aspirator and said secondary input port to join with said primary flow.

2. In an in situ minefield injection hole as defined in claim 1 the combination wherein said upper neck portion comprises a cylindrical shaft integral with said hollow core device and having a rounded upper knob larger in diameter than said cylindrical shaft and smaller in diameter than the internal diameter of said primary fluid tubing string whereby a wire-line fishing tool may be dropped through said primary fluid tubing string to engage said neck portion and withdraw said core device.

3. In an in situ minefield injection hole as defined in claim 1, the combination wherein said venturi chamber comprises a restricted passageway formed within said hollow core device adjacent said secondary input port.

* * * * *